US006978818B1

(12) United States Patent
Vicktorius et al.

(10) Patent No.: US 6,978,818 B1
(45) Date of Patent: Dec. 27, 2005

(54) DEVICE FOR AFFIXING ADHESIVE LABELS TO GOODS PACKAGES

(75) Inventors: Winfried Vicktorius, Duisburg (DE); Ralf Dippe, Duisburg (DE)

(73) Assignee: Espera Werke GmbH, Duisburg (DE)

( * ) Notice: Subject to any disclaimer, the term of this patent is extended or adjusted under 35 U.S.C. 154(b) by 121 days.

(21) Appl. No.: 10/129,065

(22) PCT Filed: Jul. 26, 2000

(86) PCT No.: PCT/EP00/07130

§ 371 (c)(1),
(2), (4) Date: Jul. 22, 2002

(87) PCT Pub. No.: WO01/33085

PCT Pub. Date: May 10, 2001

(30) Foreign Application Priority Data

Oct. 30, 1999 (DE) ..... 199 52 375

(51) Int. Cl.[7] ..... B65C 9/26; B65C 9/36

(52) U.S. Cl. ..... 156/556; 156/558; 156/566; 156/DIG. 28; 156/DIG. 37; 156/DIG. 42

(58) Field of Search ..... 156/556, 558, 156/566, 586, DIG. 24, DIG. 28, DIG. 31, 156/DIG. 37, DIG. 38, DIG. 44, DIG. 42

(56) References Cited

U.S. PATENT DOCUMENTS

| | | | | | |
|---|---|---|---|---|---|
| 4,124,436 | A * | 11/1978 | Pettis, Jr. et al. | ..... | 156/542 |
| 4,255,220 | A * | 3/1981 | Kucheck et al. | ..... | 156/285 |
| 4,475,978 | A * | 10/1984 | Bartl | ..... | 156/497 |
| 4,556,443 | A * | 12/1985 | Moya | ..... | 156/356 |
| 4,595,447 | A * | 6/1986 | Lindstrom | ..... | 156/364 |
| 4,822,448 | A * | 4/1989 | Thompson et al. | ..... | 156/538 |
| 5,198,247 | A * | 3/1993 | Bartimes et al. | ..... | 156/DIG. 31 |
| 5,266,149 | A * | 11/1993 | Collette et al. | ..... | 156/571 |
| 5,833,803 | A * | 11/1998 | Strohmeyer et al. | ..... | 156/517 |
| 6,009,926 | A | 1/2000 | Vicktorius et al. | | |
| 6,491,080 | B2 * | 12/2002 | Tasma | ..... | 156/387 |
| 6,595,259 | B2 * | 7/2003 | Whitby | ..... | 156/556 |

FOREIGN PATENT DOCUMENTS

| | | | | |
|---|---|---|---|---|
| DE | 42 01 464 C2 | | 7/1993 | |
| DE | 4428242 A1 | | 2/1996 | |
| DE | 298 12 712 U1 | | 11/1998 | |
| EP | 893725 A1 | * | 1/1999 | ..... G02B 15/177 |
| GB | 1 363 021 | | 8/1974 | |
| GB | 1 372 392 | | 10/1974 | |

* cited by examiner

*Primary Examiner*—Sue A. Purvis
(74) *Attorney, Agent, or Firm*—Proskauer Rose LLP

(57) ABSTRACT

A device for affixing an adhesive label to a package comprises a piston and cylinder. The cylinder comprises two connections arranged on a wall of the cylinder spaced apart from each other, which are alternatively connected to either a positive or a negative pressure media source. The connections control the movement of the piston inside the cylinder so that the piston can move between a first dead center position and a second dead center position thereby causing a stamp to affix a label to the package. Shortly before reaching the first dead center, the piston blocks the first connection with its cylindrical wall, thereby stopping any increase in negative pressure between the piston and the first dead end position.

8 Claims, 5 Drawing Sheets

DEVICE FOR AFFIXING ADHESIVE LABELS TO GOODS PACKAGES

BACKGROUND OF THE INVENTION

The invention relates to a device for affixing adhesive labels to goods packages, according to the precharacterising part of claim 1.

From printed publication DE 195 31 426 A1, a device for affixing adhesive labels to goods packages according to the enclosed FIG. 4 is known. It comprises a cylinder 1 in which a piston 2 is movably arranged. On the jacket of cylinder 1, connections 3 and 4 are arranged which, by alternative connection to a compressed-air source and/or negative-pressure source, cause the piston to move in the cylinder. Movement of the piston 2 is transmitted to a stamp 6 via a bolt 9 and a piston rod 5, said stamp 6 protruding from the cylinder. Adhesive labels (not shown in FIG. 4, but known from the above-named printed publication) are fed to the stamp 6. Having been fed to the stamp 6, said adhesive labels are then affixed to goods packages 50 by movement of the piston 2 and the stamp 6.

DE 195 31 426 A1 further discloses the special embodiment of the cylinder 1 shown in the enclosed FIG. 5. According to this embodiment, the cylinder 1, at its end facing away from the stamp, comprises a pneumatic damping unit 10 which closes off the cylinder in that region. The damping unit comprises a pneumatic cylinder 11 in which a damping piston 12 is guided, whose piston rod 13 protrudes into the inside of the cylinder 1.

On its surface, the piston 2 comprises a permanent magnet 7 which pushes against a ferromagnetic counter ring 8 when it has reached a minimum distance from the pneumatic damping unit 10, i.e. in a first dead centre position. The connection 3 is located on the jacket of the cylinder 1 in a region between the counter ring 8 and the pneumatic damping unit 10. Since the movement of the piston 2 is limited by the counter ring 8, i.e. by the first dead centre position defined by it, at no time during operation of the device is the connection 3 closed off by the wall of the piston 2.

In order to move the piston 2 into the first dead centre position, negative pressure is built up in the interior of the cylinder 1, above the piston 2, by way of the connection 3. This negative pressure generates an accelerating force acting on the piston 2. This accelerating force must be quite substantial if the required labelling speed or dynamics of 140 goods packages per minute is to be achieved. Furthermore, this accelerating force and the resulting speed of the piston 2 must be quickly and effectively decelerated near the turning points, i.e. dead centre positions within the cylinder. In the state of the art this happens by way of two types of damping measures.

Firstly, the surface of the piston 2 hits the piston 13 of the damping unit 10 which provides a degree of resistance to it. Secondly, shortly before the piston reaches the first dead centre position, the negative pressure is switched off, and instead, a blast of compressed air is introduced to the interior of the cylinder 1, by way of the connection 3. Said blast of compressed air also acts on the surface of the piston 2, in this way providing additional deceleration of the piston 2.

As seen from FIG. 4, the described device is not only used for labelling goods packages 50 which are of the same height, but moreover it is also used for goods packages of differing heights. The pneumatic cylinder 10 according to FIG. 5, which cylinder has been described above, requires individual adjustment for particular standard heights. Having been adjusted to a particular standard height, the device is then able to label packages with a certain tolerance range in the height of said packages. In the state of the art, resetting the device to goods packages of other standard heights requires an interruption in the labelling process and manipulation of the pneumatic damping unit 10.

SUMMARY OF THE INVENTION

It is the object of the present invention to improve the dynamic characteristics of a device, of the type mentioned in the introduction, for affixing adhesive labels to goods packages.

According to the invention, this object is met in that the first connection is fitted to such a position on the cylinder, that it can be closed off by the wall of the piston such that the build-up of negative pressure above the piston stops shortly before reaching the first dead centre position and while in it.

By stopping the build-up of the negative pressure at the top of the piston, advantageously, the accelerating application of force on the piston, which application is generated by the negative pressure, also no longer occurs. There is thus a de-facto situation where the piston decelerates as it moves towards the first dead centre position, with such deceleration occurring shortly before the piston has reached said dead centre position. The dynamics of the system are improved in that, in the present invention, deceleration of the piston takes place without mechanical action. In other words, as the piston moves towards a first dead centre position, it can be effectively decelerated in a very short time, even if it moves at high speed.

The principle according to the invention, of decelerating the piston in the cylinder, can be applied irrespective of the height of the goods packages to be labelled. Resetting the device to accommodate goods packages of other heights is thus possible without any time-consuming and costly manipulation of the device.

Because the wall of the piston closes off the first connection also in the state of the first dead centre position, this precludes any possibility in this state, of negative pressure being able to act again on the underside of the piston, which negative pressure would then cause the piston to move out of the first dead centre position.

According to an advantageous embodiment of the invention, the cylinder, at its end which defines the first dead centre position, comprises a damping unit in the form of a throttle. It makes possible additional deceleration of the movement of the piston, in that it allows a medium, e.g. air at atmospheric pressure, to enter the space above the piston.

The throttle represents a significant simplification when compared to the state of the art which provided for the damping unit to be a pneumatic cylinder with a piston guided therein and a piston rod attached to said piston.

At its top, the piston in the cylinder of the device comprises a permanent magnet which in the first dead centre position of the piston is opposed by a counter ring made of ferromagnetic material. In cooperation with the ferromagnetic counter ring, the permanent magnet makes it possible for the piston to dwell in an advantageous way in the first dead centre position.

Furthermore, it is advantageous that the connections, with controllable valves arranged in line, be alternatively connectable to a media source and/or negative-pressure source. In this way it is possible to control movement of the piston within the cylinder.

The invention provides a further advantage in that a negative-pressure valve for controlling the amount of negative pressure is provided in a suction pipe by way of which the media source and/or negative pressure source siphons a medium. In this way it is possible to flexibly adapt the stroke travel of the piston within the cylinder, and thus adapt the stroke travel of the stamp, to match the height of the goods packages to be labelled.

Furthermore, it is advantageous if the device comprises a program control system for controlling the valves. In this way, the program control system ensures supply of a medium or of negative pressure to the two connections, for controlling a desired movement of the piston.

Finally, it is advantageous if sensors, in particular Hall sensors, are provided on the outside of the cylinder, wherein said sensors generate signals about the current position and speed of the piston, and supply said signals to the program control system as input signals. To this extent they ensure proper control of the device by the program control system.

BRIEF DESCRIPTION OF THE DRAWINGS

The invention is accompanied by figures showing the following.

DETAILED DESCRIPTION OF THE INVENTION

Figure 1:
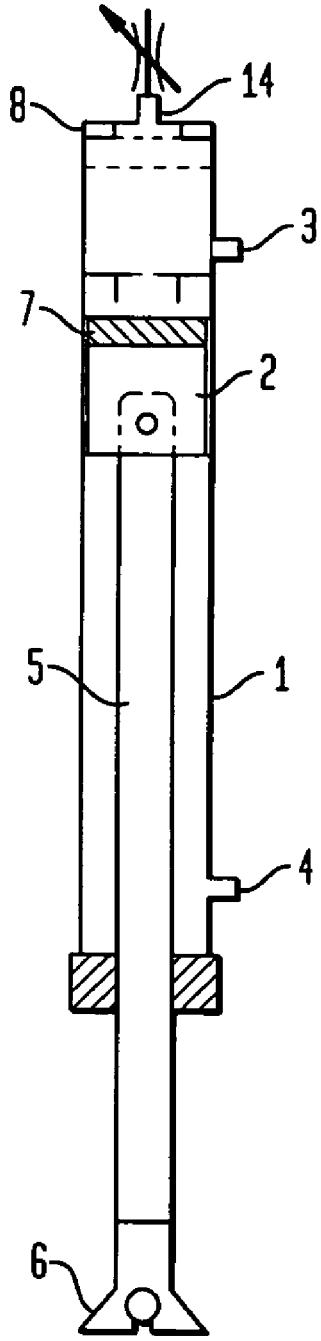
FIG. 1 the device according to the invention, for affixing adhesive labels to goods packages.
Figure 2:
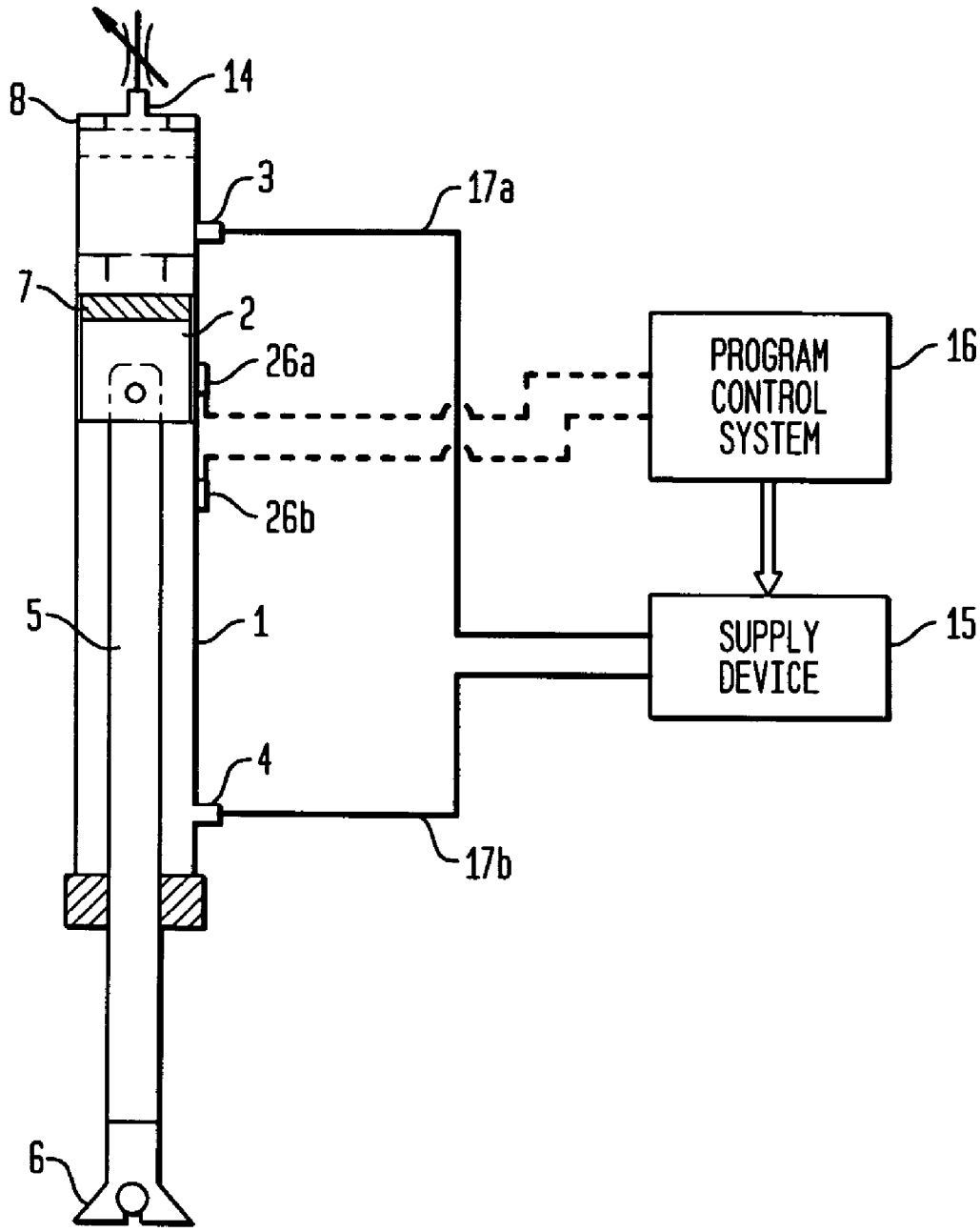
FIG. 2 the device according to FIG. 1, connected to a program control system and to a supply device.
Figure 3:
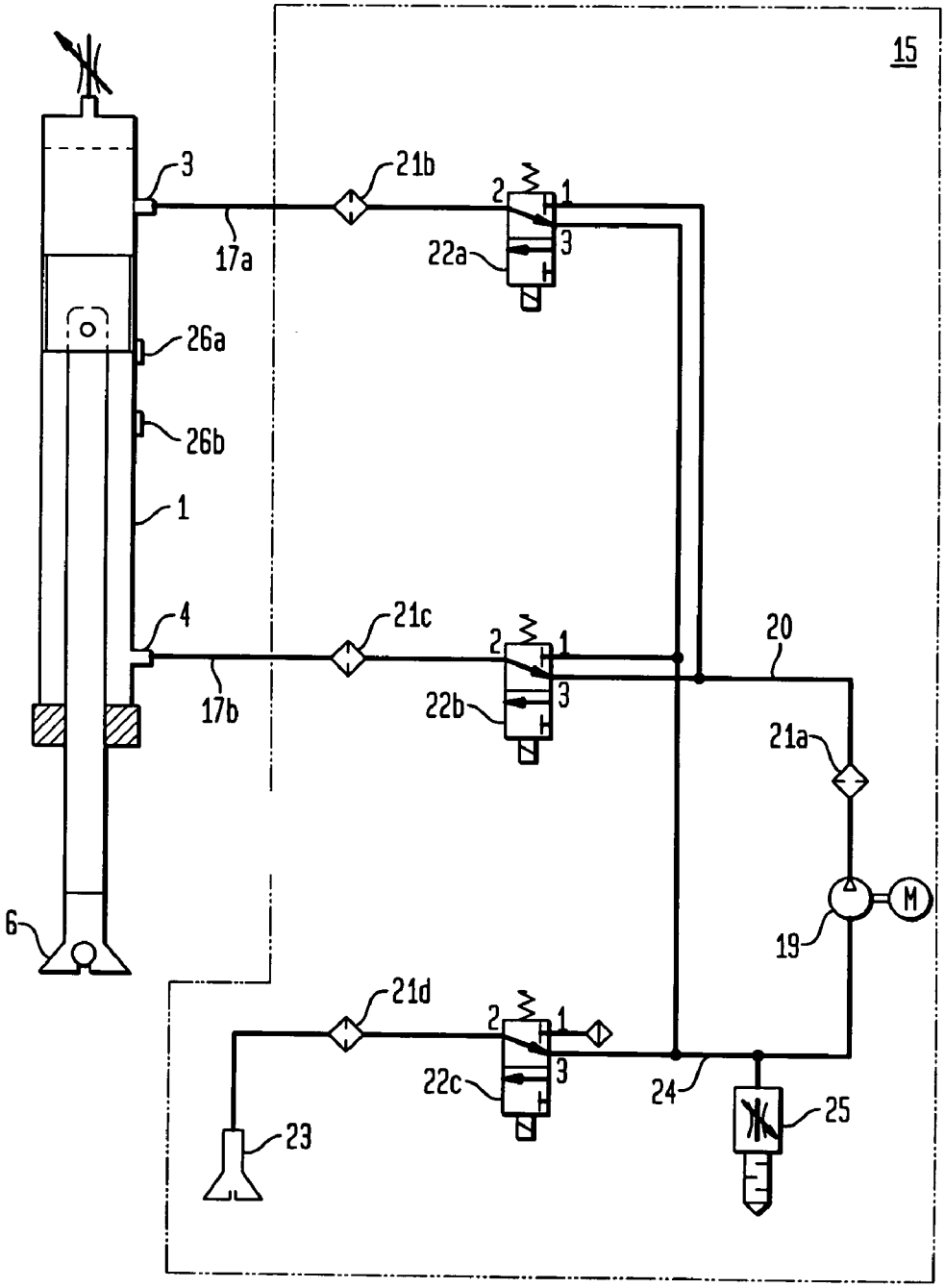
FIG. 3 a detailed diagrammatic representation of the supply device.

The following is a detailed description of an embodiment of the invention, with reference to FIGS. 1 to 3. The embodiment shown uses compressed air as a medium; but instead of compressed air, any other medium suitable for moving the piston in the cylinder, if necessary at the required pressure, can be used.

Figure 4:
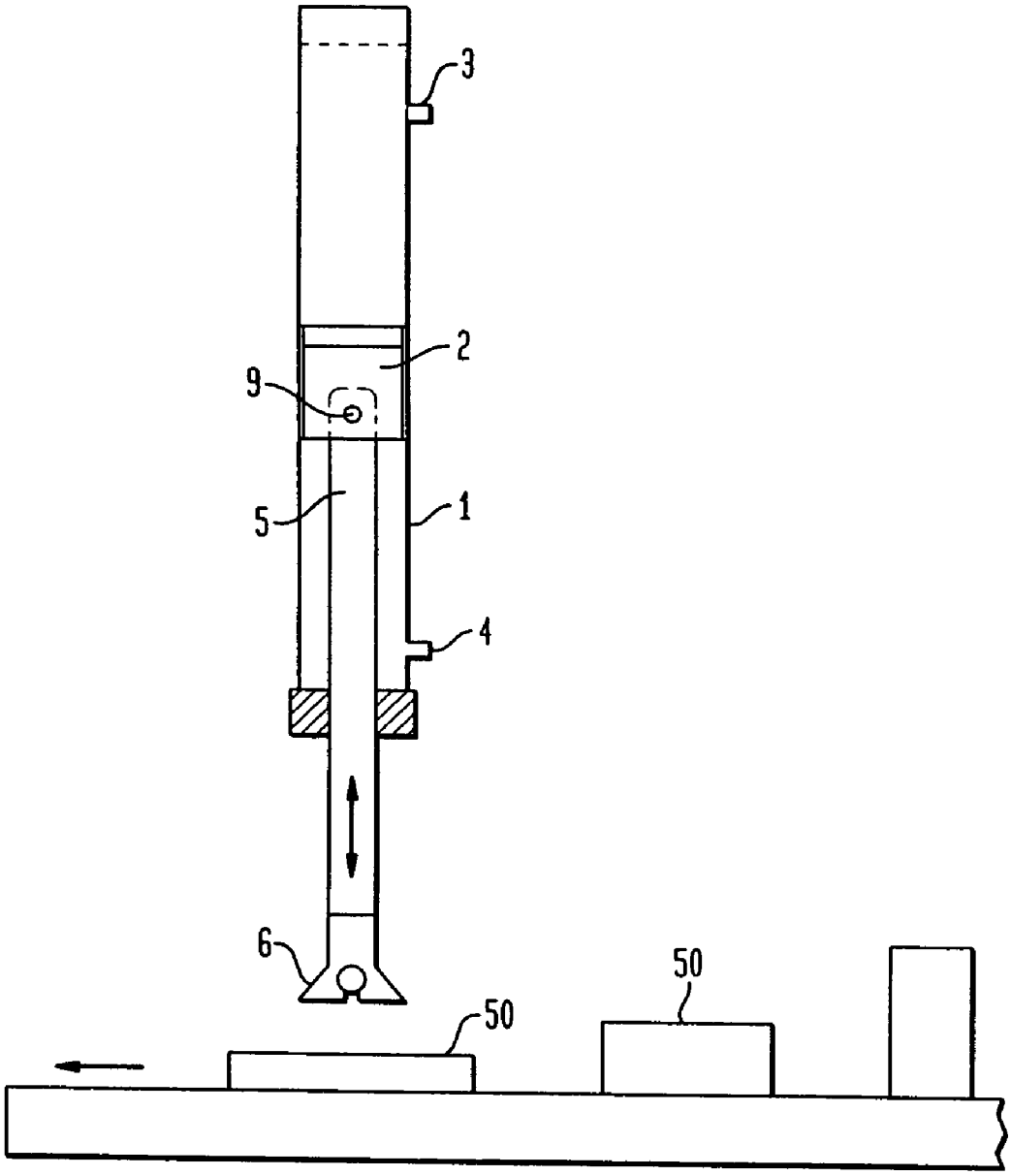
FIG. 4 (PRIOR ART)
FIG. 4 a diagrammatic representation of a device for affixing adhesive labels to goods packages, according to the state of the art.
Figure 5:
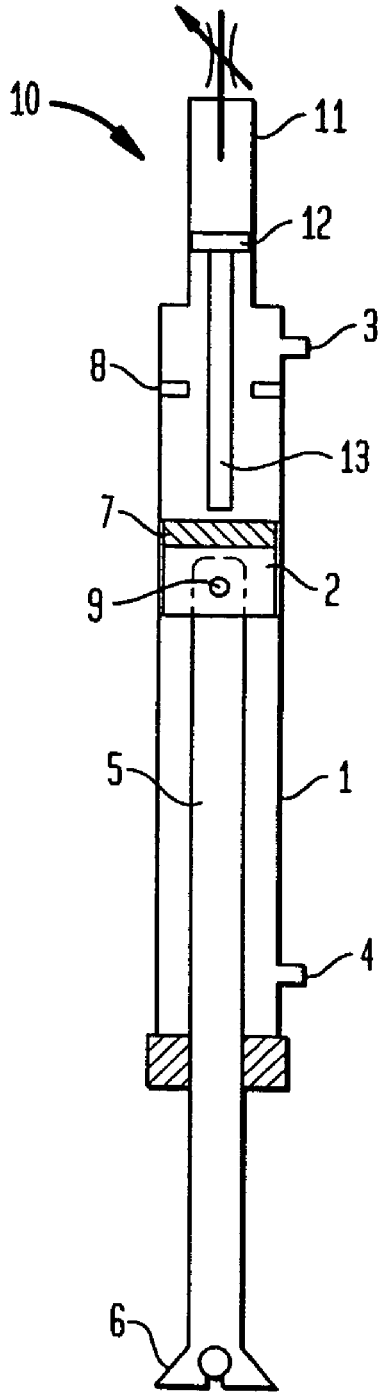
FIG. 5 (PRIOR ART)
FIG. 5 a concrete embodiment of the device according to FIG. 4, from the state of the art.

FIG. 1 shows a device for affixing adhesive labels to goods packages with a cylinder 1 in which a piston 2 is guided. Arranged on the jacket of the cylinder 1, spaced apart from each other, are a first and a second connection 3, 4. The piston 2 is connected via a piston rod 5 to a stamp 6 which exits at one end of the cylinder and is used to affix adhesive labels to goods packages 50 according to FIG. 4. Attached to the top of the piston 2 is a permanent magnet 7 which in the position where the piston rod is retracted in the cylinder as far as possible, i.e. when the first dead centre position has been reached, is facing a ferromagnetic counter ring 8 and directly touches said ferromagnetic counter ring 8 (see FIG. 1 where the dot-dash line denotes the position of the piston).

At the end of the cylinder 1, when the piston 2 is in the first dead centre position, the cylinder is closed off by a damping unit 14. The damping unit 14, which for example is a pneumatic damping unit, is a throttle, preferably a throttle valve; i.e. by means of it, admission of a medium, in particular air at atmospheric pressure, to the interior of the cylinder above the piston 2, can be controlled.

During operation of the device, the piston 2 and thus also the stamp 6 are moved in the direction of the longitudinal axis of cylinder 1. This happens in that alternatively compressed air and/or negative pressure is admitted to the first and/or the second connection 3, 4. In order to move the piston in the direction of the first dead centre position, negative pressure is made to impinge upon the top of the piston 2 by way of connection 3, and/or compressed air is made to impinge upon the bottom of the piston by way of connection 4. Both the negative pressure and the compressed air generate a force on the piston which accelerates said piston in the direction of the first dead centre position. Movement of the piston in the direction of a second dead centre position, in which the stamp has reached its maximum extension from cylinder 1, is caused by admitting negative pressure by way of connection 4, and/or by admitting compressed air by way of connection 3.

The device is suitable for operation in any desired skewed position or inclination. This includes, in particular, operation of the device in which the piston is moved in vertical or horizontal direction.

The device according to the embodiment is designed for labelling goods packages at speeds of up to approx. 140 units per minute. Such fast speeds require considerable dynamics of the system, i.e. the piston is subjected to very substantial acceleration after leaving the dead centre position, and is subjected to very considerable deceleration when moving towards a dead centre position. Such very considerable acceleration is, for example, achieved in that, as described above, either compressed air is applied to the bottom of the piston while at the same time negative pressure is applied to the top of the piston, or vice versa.

According to the invention, deceleration of the piston 2 during movement towards the first dead centre position is achieved in that the piston, shortly before reaching the first dead centre position, closes off the connection 3 with its wall and in this way stops any further buildup of negative pressure at its top. Immediately thereafter, the negative pressure which remains above the piston 2, is compensated for by a medium, preferably air at atmospheric pressure, said medium being conveyed to the interior of the cylinder by way of the damping unit 14 which acts as a throttle. Such compensation of the negative pressure to the level of atmospheric pressure takes place within a very short time. It thus acts quasi as a blast of compressed air, acting against the direction of movement of the piston, thus providing very considerable deceleration in addition to only switching off the negative pressure. The deceleration effect, which the described compensation of negative pressure has on the piston, is so considerable that there is no need for any further damping devices, in particular mechanic pneumatic damping devices, to be used.

The device thus makes possible both very considerable acceleration and very considerable deceleration of the piston, exclusively by controlling the air pressure relationships at its top and bottom. This provides the advantage that the stroke of the piston can be set very flexibly across a large range. This makes possible the labelling of goods packages of different heights, without the need for resetting the equipment.

FIG. 2 shows the connection of the device, necessary for operation, to a supply device 15 and to a program control system 16. The supply device 15 provides, for example, compressed air as a medium and/or negative pressure for the two connections 3, 4. Said supply device 15 is connected to the connections 3 and 4 by way of the pressure/suction pipes 17*a* and 17*b*. The program control system 16 controls the supply device 15. During operation, the setting of the throttle of the damping unit 14 is not changed.

FIG. 3 shows a diagrammatic construction of the supply device 15. It comprises a device 19 which, driven by a motor M, can be operated as a media source and/or negative pressure source. If it is operated as a media source, it generates e.g. compressed air which is first conveyed to two ⅔ way valves 22*a*, 22*b*, by way of the pressure pipes 20 which comprise a built-in filter 21*a*.

The ⅔ way valve 22*a* conveys the compressed air to the connection 3 of the cylinder 1, by way of the pressure pipe/suction pipe 17*a* which comprises a built-in filter 21*b*. As an alternative or at the same time, if necessary the compressed air generated is conveyed by the ⅔ way valve 22*b* to the connection 4 via the pressure pipe/suction pipe 17*b* which comprises a built-in air filter 21*c*.

In order to generate the compressed air, the device 19 aspirates ambient air by way of a medium inlet device 23, a filter 21*d* and a further ⅔ way valve 22*c*.

All the ⅔ way valves as well as the device 19 are individually controlled by the program control system 16, according to the desired operating conditions. Signals, which among other things are provided by Hall sensors 26*a*, 26*b*, located on the outside of the cylinder, are used as input signals for the program control system 16. These signals are evaluated by the program control device so as to determine the current position and speed of the piston 2.

During negative-pressure operation, the device 19 syphons air from the interior of the cylinder either by way of connection 3 and/or connection 4. If e.g. air is syphoned from the cylinder by way of connection 3, then said air is conveyed to the ⅔ way valve 22*a* by way of the pressure pipe/suction pipe 17*a* and the air filter 21*b*, wherein said ⅔ way valve 22*a* conveys the air, which has been removed by suction, to the device 19 by way of a suction pipe 24. Analogously, removal by suction of air, from the interior of the cylinder is by way of connection 4, pressure pipe/suction pipe 17*b*, air filter 21*c*, ⅔ way valve 22*b*, and suction pipe 24.

A negative pressure valve 25 is provided in the suction pipe 24; said negative pressure valve making it possible to set the amount of negative pressure to be generated in the cylinder, by partial compensation with atmospheric pressure.

This variable setting of the amount of negative pressure allows very precise control of the piston in the cylinder. Thus it is, for example, possible to keep the piston poised in a particular position in the interior of the cylinder 1. This requires a balanced equilibrium of forces which can be achieved by respectively finely set compressed-air and negative pressure conditions at the top and bottom of the piston. This poised position is used in order to rotate a label, which has previously been picked up by the stamp, with the piston rod not extended, to the right position before affixing it to the respective goods package. There is a further advantage in that the actual stroke of the stamp can be better controlled/regulated from this state, because the permanent magnet of the piston no longer exerts any force on the ferromagnetic ring.

In addition, the possibility of setting the amount of negative pressure is advantageous for flexible adaptation of the piston stroke or stamp stroke, to a change in height of the goods packages to be labelled.

What is claimed is:

1. In a device for affixing an adhesive label to a package, comprising a piston and a cylinder, said cylinder comprising:

first and second connections arranged on a wall of the cylinder so as to be spaced apart from each other, said connections controlling the movement of said piston inside the cylinder by being alternatively connected to a pressure media source, to a source of negative-pressure or to a combination thereof, so that said piston is movable between a first dead center position near a first end of the cylinder, and a second dead center position near a second end of the cylinder, thereby causing a stamp to affix a label to the package, wherein the first connection is located at a position on the wall of the cylinder so that it is fully blocked by a cylindrical wall of the piston shortly before the piston reaches the first dead center position, thereby stopping any increase in negative pressure between the piston and the first end of the cylinder before the piston reaches its first dead center position.

2. The device of claim 1, wherein the cylinder further comprises at its first end a damping unit in the form of a throttle for admitting a medium at positive pressure to the interior of the cylinder above the piston.

3. The device of claim 2, wherein said medium is at atmospheric pressure.

4. The device of claim 1, wherein the top face of the piston comprises a permanent magnet, and a counter ring of ferromagnetic material is located at the first end of the cylinder to oppose the piston when it reaches its first dead center position.

5. The device according to claim 1, wherein the device further comprises controllable valves arranged in lines connected to said first and second connections for selectively connecting said connections to the pressure medium source, to the source of negative pressure or to the combination thereof.

6. The device according to claim 1, further comprising a suction pipe connected to the atmosphere and a negative-pressure valve for controlling the amount of negative pressure introduced into the cylinder, wherein the pressure medium source, the source of negative-pressure, or the combination thereof aspirate air by way of the suction pipe.

7. The device according to claim 5, further comprising a program control system for controlling the controllable valves.

8. The device according to claim 7, further comprising sensors located outside the cylinder, wherein said sensors register the position and speed of the piston as input signals for the program control system.

* * * * *